US010845145B1

(12) United States Patent
Baskett

(10) Patent No.: US 10,845,145 B1
(45) Date of Patent: Nov. 24, 2020

(54) REVOLVER CYLINDER RELEASE LEVER

(71) Applicant: David E. Baskett, Santa Maria, CA (US)

(72) Inventor: David E. Baskett, Santa Maria, CA (US)

(73) Assignees: David E. Baskett, Santa Maria, CA (US); Franziska Shepard, Santa Maria, CA (US)

( * ) Notice: Subject to any disclaimer, the term of this patent is extended or adjusted under 35 U.S.C. 154(b) by 0 days.

(21) Appl. No.: 16/292,816

(22) Filed: Mar. 5, 2019

(51) Int. Cl.
*F41A 15/02* (2006.01)
*F41C 3/14* (2006.01)
*F41A 19/52* (2006.01)

(52) U.S. Cl.
CPC ..... *F41A 15/02* (2013.01); *F41C 3/14* (2013.01); *F41A 19/52* (2013.01)

(58) Field of Classification Search
CPC ..... F41A 15/02; F41C 3/14
See application file for complete search history.

(56) References Cited

U.S. PATENT DOCUMENTS 4,769,936 A * 9/1988 Miller ..... F41A 17/74 42/66
4,835,892 A * 6/1989 Ruger ..... F41A 35/06 42/7
8,112,926 B2 * 2/2012 Gussalli Beretta ..... F41A 17/38 42/6
8,695,477 B2 * 4/2014 Esch ..... F41A 17/42 42/14
9,518,792 B1 * 12/2016 Huang ..... F41A 35/00
2003/0208940 A1 * 11/2003 Johnson ..... F41A 3/12 42/18
2010/0192440 A1 * 8/2010 Curry ..... F41C 3/14 42/62

FOREIGN PATENT DOCUMENTS

WO WO81/03065 10/1981

* cited by examiner

*Primary Examiner* — Gabriel J. Klein
(74) *Attorney, Agent, or Firm* — Fitch, Even, Tabin & Flannery LLP

(57) ABSTRACT

A Ruger® revolver has a cylinder release button for loading/unloading that is stiff. It is difficult to push into the frame to release the cylinder. A spring force keeps the cylinder locking rod pushed rearward into a locking hole. When the cylinder release button is pushed into the frame, a short lever arm moves the release arm pin forward to overcome the spring bias force rearward. The present invention attaches to the face of the release button to extend the lever arm from the fulcrum of the cylinder release rod. A bolt and/or glue can attach the extension lever arm to the face of the cylinder release face. A factory model could provide a one piece cylinder release rod with an extended rearward projecting face.

9 Claims, 4 Drawing Sheets

REVOLVER CYLINDER RELEASE LEVER

FIELD OF THE PRESENT INVENTION

The present invention relates to adding a lever extension to a cylinder release button such that a necessary inward, toward the revolver body, force is reduced.

BACKGROUND

Revolver cylinder actions have evolved over the years to provide an automatic revolving action as the trigger is pulled. Each time the hammer hits a chamber in the cylinder, the cylinder has automatically advanced by one chamber. International Publication Number WO81/03065 (29 Oct. 1981) discloses an improved cylinder latch mechanism for revolvers that eliminates the possibility of loss of the cylinder latch or misassembly of the mechanism itself by securely mounting the pivoted cylinder latch on the frame or on the trigger guard of the revolver.

All double action revolvers have a hinged cylinder with a manually activated cylinder release button on the frame. Colt® and Smith & Wesson® have a forward (Smith) or backward (Colt) sliding release button that is quite easy to activate. One reason is that the shooter's hand is gripped around the pistol grip for stability, and the thumb can exert the necessary force either forward or backward to release the cylinder.

The Ruger® cylinder release mechanism requires the thumb to press down into the frame on a spring biased button. This lateral left to right force cannot be executed by the shooter when he/she has a full grip on the pistol grip. Thus, for women shooters, or any shooter such as a younger child, depressing the cylinder release button can be difficult if not impossible.

What is needed in the art is a cylinder release lever extension for a Ruger® revolver that reduces the lateral left to right force needed to depress the cylinder release button. The present invention provides an aftermarket accessory lever that is attached to the factory cylinder release button to extend the lever arm on the cylinder release button. An original factory model is also disclosed.

SUMMARY OF THE INVENTION

The main aspect of the present invention is to extend the lever arm of a Ruger® cylinder release button with an aftermarket accessory.

Another aspect of the present invention is to provide a factory original version.

Other aspects of this invention will appear from the following description and appended claims, reference being made to the accompanying drawings forming a part of this specification wherein like reference characters designate corresponding parts in the several views.

The aftermarket embodiment is a slightly curved lever that fits into the factory cylinder release button and extends rearward at least half the diameter of the cylinder release button. A hole is drilled through the lever and into the cylinder release button. The holes are threaded. A threaded fastener bolt is used to secure the lever against the cylinder release button. An adhesive could be used either as an alternate means to fasten or an additional means to fasten.

In use the rearward tip of the lever is easily depressed to release the cylinder for loading.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Figure 1:
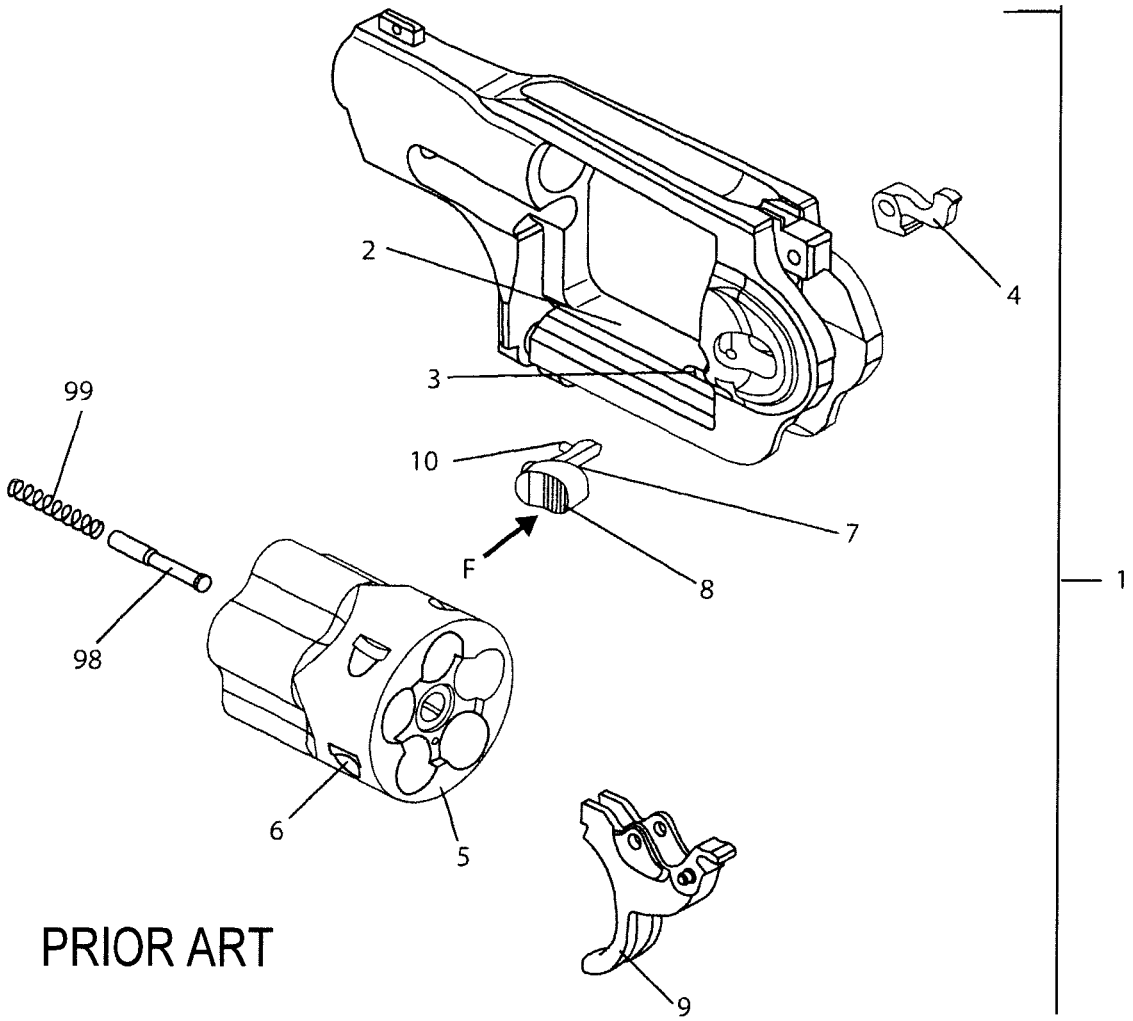
FIG. 1 (prior art) is a partial exploded view of the cylinder release assembly of a Ruger® SP101.
Figure 2:
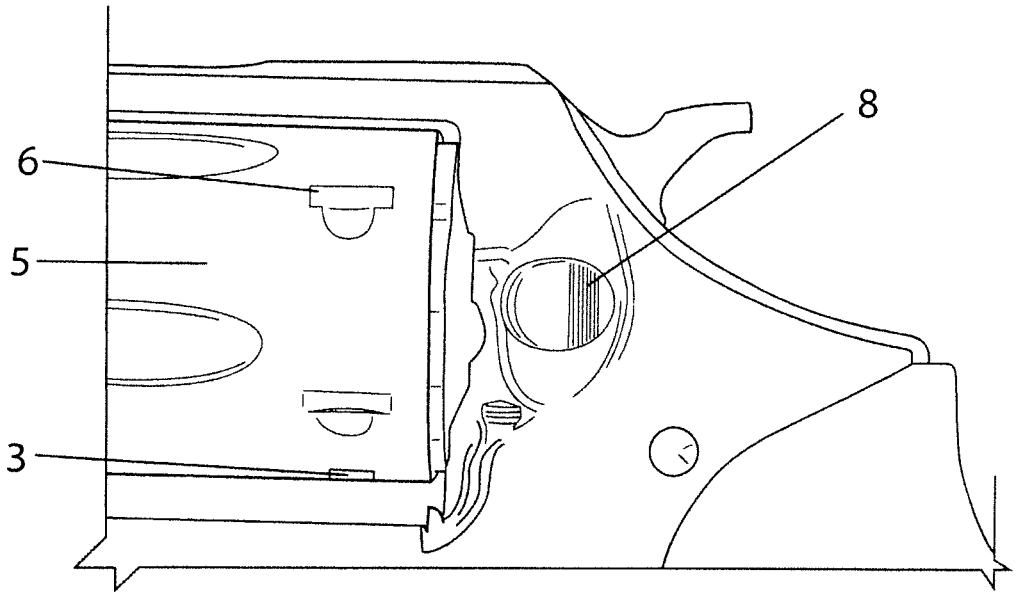
Fig. 2 PRIOR ART
FIG. 2 (prior art) is a side elevation view of the cylinder release button of a Ruger® SP101.

Referring first to FIGS. 1,2 a Ruger® Model SP101 is shown in an exploded view. The frame 2 has a slot 3 into which the cylinder release latch 4 extends. When the cylinder 5 is locked, the latch 4 seats into grooves 6. The trigger 9 forces the latch 4 down for rotation of the cylinder 5.

The cylinder release rod 7 has a ridged finger face 8. The shooter exerts a line of effort force F on the ridged finger face 8 to move the pin 10 forward to release the cylinder 5 to open for loading. Several pounds of force F are needed to overcome a spring force to move pin 10 forward. In referring to FIG. 1 when the ridged finger face 8 is pushed into the frame, the pin 10 is pushed into the frame, the pin 10 is pushed against the cylinder locking rod 98 to release the cylinder 5 from the frame 2. The force from spring 99 must be overcome to push the cylinder locking rod 98 forward. It is this spring 99 force that is difficult to overcome if you have a weak thumb.

Figure 3:
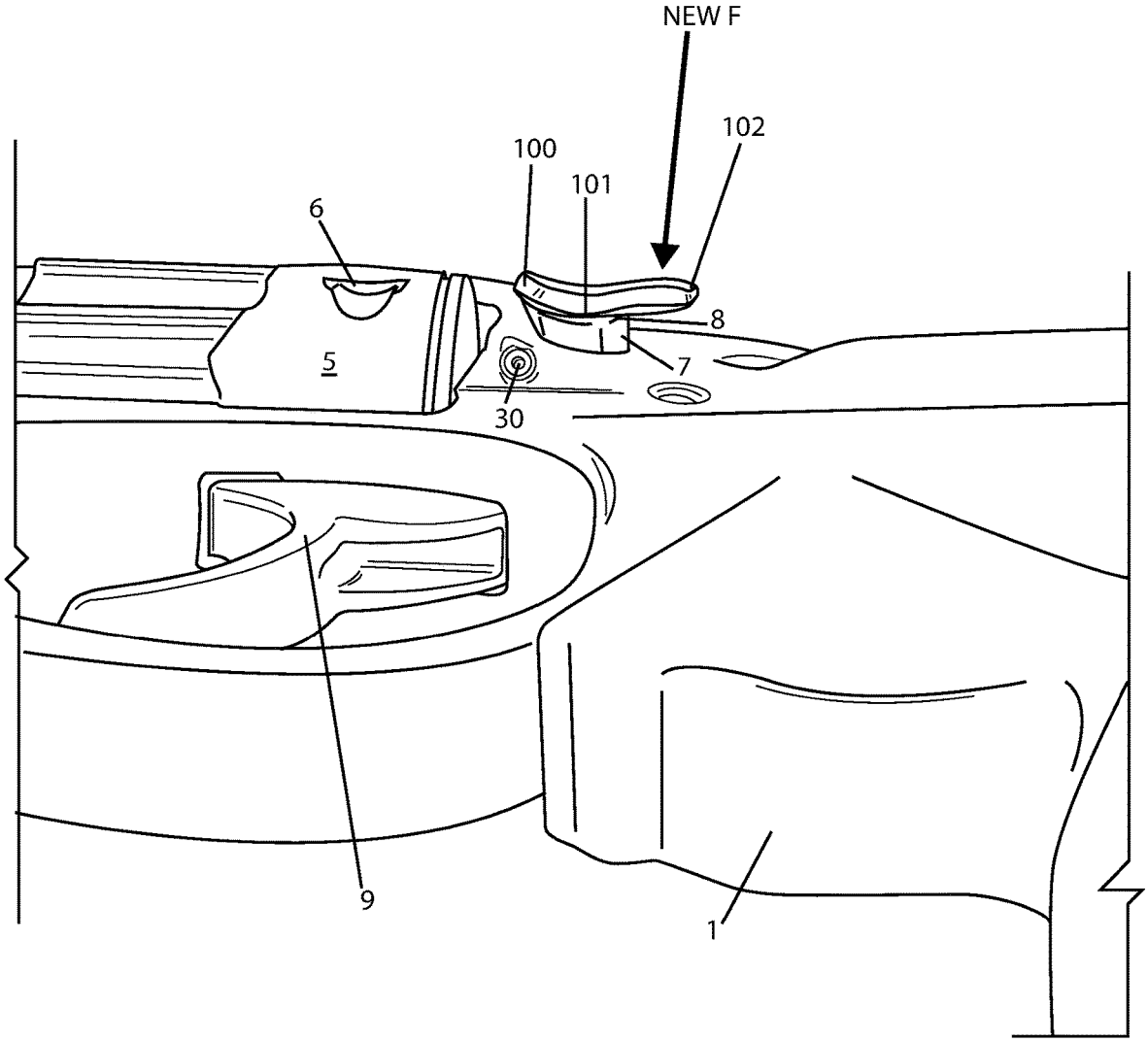
FIG. 3 is a bottom perspective view of the aftermarket embodiment installed on a Ruger® revolver.

Referring next to FIG. 3 the cylinder release rod 7 can be removed for maintenance by unscrewing the screw 30. It is seen that the ridged finger face 8 is slightly concave. The accessory lever 100 has a matching convex bottom 101 to the concave ridged finger face 8. The accessory lever 100 has a rearward facing force tip 102 on which the shooter exerts the line of action effort force NEW F to release the cylinder 5.

Figure 4:
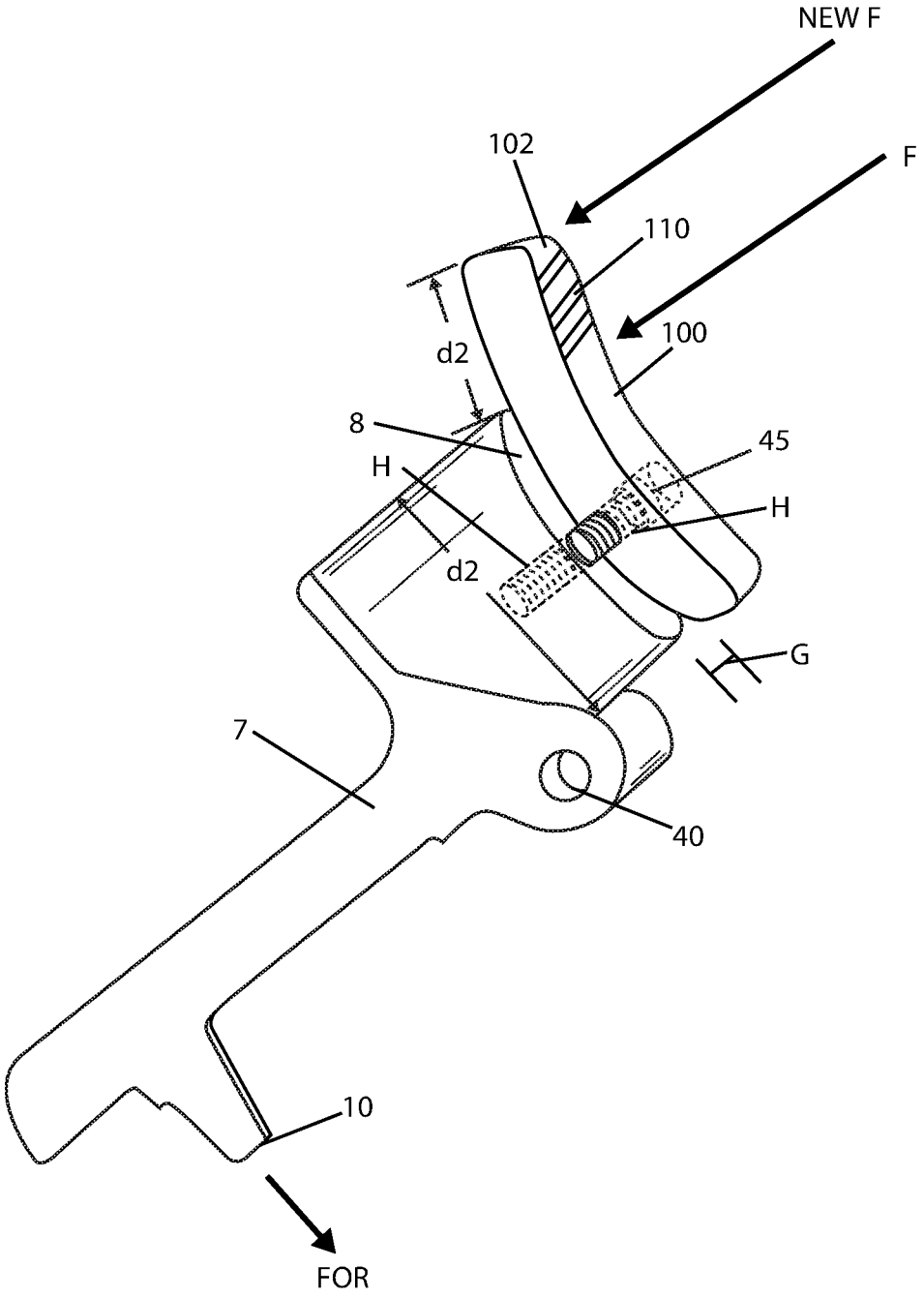
FIG. 4 is an exploded view of the lever attached to the internal cylinder release lever.

Referring next to FIG. 4 the approximate length d1 of the ridged finger face 8 is about 5/16 inch. The extension distance d2 ranges from about 2/16 inch to about 4/16 inch. The embodiment shown in FIG. 3 has about a 3/16 inch distance d2, which is about one half the length of ridged finger face 8. The fulcrum 40 allows pin 10 to move forward in direction FOR. The old line of action force F is shown with arrow F. The new line of action force is shown with arrow NEW F.

For installation of the lever 100 the preferred method is to drill a hole H through both the lever 100 and the release rod 7. Next the hole H is threaded as shown. Next a bolt 45 is screwed into hole H. Additionally a glue G could be inserted between the lever 100 and the ridged finger face 8.

Alternately just a glue G could be used. Another embodiment implied but not drawn is a factory made one piece combination of the release rod 7 and the lever 100.

The lever 100 allows a woman or any weaker handed shooter to easily release the cylinder 5. The approximately force NEW F is about optional ridges 110 are shown on the lever 100. The thickness of the lever can range from about 1/16 to about 3/16 inch.

While a number of exemplifying features and embodiments have been discussed above, those of skill in the art will recognize certain modifications, permutations, additions and subcombinations thereof. No limitation with respect to the specific embodiments disclosed herein is intended or should be inferred.

I claim:

1. In a revolver having a frame, a hinged cylinder, and a central spring loaded cylinder-locking rod facing rearward and having a pivoting cylinder release rod pivotally coupled to the frame at a fulcrum and with a release pin engaged with the spring loaded cylinder locking rod, the pivoting cylinder release rod having an integral cylinder release button including a ridged finger face, the cylinder release button requiring a manual force inward toward the revolver frame in order to pivot the pivoting cylinder release rod about the fulcrum, thus moving the release pin forward to push the spring loaded cylinder locking rod forward, thus releasing the cylinder from the frame, an improvement comprising:

a lever arm mounted on the ridged finger face, wherein a bottom surface of the lever arm is juxtaposed with the ridged finger face;

said lever arm having a rearward projection over a surface of the frame such that a magnitude of the manual force required on the rearward projection to pivot the pivoting cylinder is less than a magnitude of the manual force required on the cylinder release face to release the cylinder from the frame, wherein the ridged finger face is concave, and the lever arm bottom surface is a convex surface matching the concave ridged finger face.

2. The improvement of claim 1, wherein the lever arm has a length beyond a rear edge of the ridged finger face of at least one half a length of the ridged finger face.

3. The improvement of claim 2, wherein a threaded mounting hole runs through the lever arm and the cylinder release button, and a bolt is threaded through the threaded hole to mount the lever arm to the ridged finger face.

4. The improvement of claim 3 further comprising a glue between the lever arm and the ridged finger face.

5. The improvement of claim 1, wherein the lever arm has a non-ridged top surface over the ridged finger face and ridges on a top surface of the rearward projection.

6. The improvement of claim 1 further comprising a glue between the lever arm and the ridged finger face.

7. The improvement of claim 1, wherein a length of the rearward projection is at least 2/16 inch.

8. The improvement of claim 1, wherein the lever arm is curved to match a curvature of the ridged finger face.

9. The improvement of claim 1, wherein the lever arm has a generally uniform thickness ranging from 1/16 inch to 3/16 inch.

* * * * *